US007437087B2

(12) United States Patent
Matsunai

(10) Patent No.: US 7,437,087 B2
(45) **Date of Patent: *Oct. 14, 2008**

(54) IMAGE FORMING APPARATUS AND IMAGE FORMING METHOD

(75) Inventor: Tomohiro Matsunai, Yokohama (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 11/727,443

(22) Filed: Mar. 27, 2007

(65) Prior Publication Data

US 2007/0166061 A1 Jul. 19, 2007

Related U.S. Application Data

(63) Continuation of application No. 10/985,897, filed on Nov. 12, 2004, now Pat. No. 7,206,528.

(51) Int. Cl.
*G03G 15/00* (2006.01)

(52) U.S. Cl. ..... 399/43

(58) Field of Classification Search ..... 399/16, 399/18, 43, 391, 393, 27
See application file for complete search history.

(56) References Cited

U.S. PATENT DOCUMENTS 5,095,331 A 3/1992 Takano
7,206,528 B2 * 4/2007 Matsunai ..... 399/43
2002/0024585 A1 * 2/2002 Kim et al.
2004/0223791 A1 * 11/2004 Yamada et al.
2005/0019043 A1 * 1/2005 Kato et al.

FOREIGN PATENT DOCUMENTS

JP 10260618 A * 9/1998
JP 2000-162925 A 6/2000
JP 2000330408 A * 11/2000
JP 2003-114567 A 4/2003

* cited by examiner

*Primary Examiner*—Susan S Lee
(74) *Attorney, Agent, or Firm*—Foley & Lardner LLP

(57) ABSTRACT

An image forming apparatus includes a toner bottle, a supply unit that supplies toner from the toner bottle to a downstream side, a door that is openably provided to execute toner replenishment, an opening/closing sensor that senses opening/closing of the door, and a unit that renders the supply unit inoperable if the door is open. If the opening/closing sensor detects the opening of the door, counting of the number of prints is started. Then, the control unit detects whether the door is closed. If the door is still opening, the control unit checks whether the number of prints has reached a predetermined value. If not, the control unit sets the image forming apparatus in a printing state. If yes, the control unit stops the printing operation. If the closing of the door is detected, the control unit resets the count value. Subsequently, the control unit determines whether the initial value of the number of prints, which is set through a control panel at the time of starting the printing operation, is reached. If the initial value is reached, the printing operation is completed.

14 Claims, 3 Drawing Sheets

IMAGE FORMING APPARATUS AND IMAGE FORMING METHOD

The present application is a continuation of U.S. application Ser. No. 10/985,897, filed Nov. 12, 2004, the entire contents of which is incorporated herein by reference.

BACKGROUND OF THE INVENTION

1. Field of the Invention

The present invention relates to an image forming apparatus, such as a facsimile, a laser printer or a copying machine, to which electrophotography is applied, and more particularly to an image forming apparatus and an image forming method, which can execute a control to enable toner replenishment (toner bottle replacement) while continuing a printing operation without a halt when printing is being effected.

2. Description of the Related Art

In general, an image forming apparatus, such as a facsimile, a laser printer or a copying machine, to which electrophotography is applied, includes an image forming section that applies toner to an electrostatic latent image, which is formed on the surface of a photoconductor drum, and forms a visible toner image. The toner image, which is formed on the surface of the photoconductor drum by a developing unit that is a part of the image forming section, is transferred to paper by a transfer unit. The paper with the transferred toner image is conveyed to a fixing unit, and the toner image is fixed on the paper by a fixing device of the fixing unit.

In the prior-art image forming apparatus, the developing unit is provided with a sensor for detecting the amount of toner. If the sensor detects that the toner amount is a preset value or less, the image forming apparatus executes a control not to perform a further printing operation in order to prevent a decrease in density of a print image, to display a message prompting the user to replenish toner, and to stop a printing operation until the toner replenishment is completed.

In recent years, many users execute large-volume printing with an increase in operation speed of the image forming apparatuses. Hence, there is a demand for increasing productivity by decreasing an idle time of the image forming apparatus due to a shortage of toner.

In order to meet this demand, a modern image forming apparatus comprises a developing unit that forms an image on a photoconductor drum using toner; a storage unit that stores toner that is to be supplied to the developing unit; a first supply unit that supplies toner from the storage unit to the developing unit; a first drive unit for driving the first supply unit; a toner bottle that contains toner and is detachably attached to the image forming apparatus; a second supply unit that supplies the toner in the toner bottle to storage unit; a second drive unit for driving the second supply unit; a first door that is openably/closably provided to remove the toner bottle; and a first sensor unit that senses the opening/closing of the first door. While the first sensor unit detects that the first door is open, the first drive unit and developing unit are controlled to be operable and the second drive unit is controlled to be inoperable.

When the toner bottle is to be taken out, the second drive unit is controlled to be inoperable on the basis of the detection result that the first door is opened. Thus, the operation of the second supply unit is stopped, and the toner bottle is not rotated and can easily be taken out. In addition, at this time, the first drive unit and developing unit are controlled to be operable. Therefore, the printing operation can be continued.

However, in this type of image forming apparatus, when the first door is opened, the printing operation is continued in the state in which the supply of toner from the toner bottle to the storage unit is stopped. Consequently, the toner in the storage unit may decrease to a predetermined amount, and the image density may lower.

Furthermore, when the first door remains opened, the temperature in the image forming apparatus lowers and the turn-on time of the heater of the fixing unit increases, leading to an increase in power consumption.

To solve these problems, a technique has been disclosed, wherein the operation of the image forming section is stopped if closing of the first door is not detected by the first sensing unit within a predetermined time period after the detection of the opening of the first door by the first sensing unit.

Jpn. Pat. Appln. KOKAI Publication No. 2003-114567, for instance, discloses a technique wherein the printing operation is stopped if a time period in which the first door is opened exceeds a predetermined value. However, in some cases, the printing operation is performed in the state in which the first door is opened, and the printing operation is stopped despite that the amount of toner in the storage unit has not yet been consumed to a predetermined level and no decrease has occurred in the density of print images. In addition, there is such a problem that if a great number of images with a high print ratio are printed after the first door is opened, the amount of toner in the storage unit decreases below a predetermined level before a predetermined time period expires, resulting in a decrease in image density.

Besides, the modern image forming apparatus includes a tray paper feed unit having a plurality of stages (e.g. trays 1-3) and a manual paper feed unit. In most of image forming apparatuses of this type, different print speeds per minute are set for the respective paper feed units. For example, tray 1 permits printing of 60 A4-size sheets per minute, tray 3 permits printing of 50 A4-size sheets per minute, and the manual paper feed unit permits printing of only 30 A4-size sheets per minute.

In this type of image forming apparatus, when continuous paper-feed printing is performed with the paper feed unit (e.g. tray 1) having a high printing speed per minute, there may be a case where the amount of toner in the storage unit decreases to a predetermined level while the time period in which the first door is opened is within a predetermined time range. This leads to a decrease in image density. On the other hand, when continuous paper-feed printing is performed with the paper feed unit (manual paper feed unit) having a low printing speed per minute, there may arise such a problem that more than a predetermined amount of toner still remains in the storage unit even when the time period in which the first door is opened is within a predetermined time range, and the operation of the image forming apparatus is stopped despite that printing with normal image density can be performed.

BRIEF SUMMARY OF THE INVENTION

The object of an aspect of the present invention is to provide an image forming apparatus and an image forming method, which can enhance productivity by enabling toner replenishment (replacement of a toner bottle) during a printing operation, and can prevent a decrease in image density during a printing operation.

According to an aspect of the present invention, there is provided an image forming apparatus comprising: a developing unit that visualizes an image; image forming material storing means for storing an image forming material; a supply unit that supplies the image forming material, which is stored in the image forming material storing means, to a downstream side; a door that covers the image forming material storing means and is openably provided; cut-off means for rendering, if the door is open, the supply unit inoperable, and rending, if the door is closed, the supply unit operable; and opening/closing sensing means for detecting opening/closing of the door, wherein while the opening/closing sensing means detects the opening of the door, the supply unit is rendered inoperable by the cut-off means and a control unit counts a number of prints during this time period, and if the counted number of prints is less than a predetermined value, the developing unit is rendered operable and the image forming apparatus is set in a printable state, and if the counted number of prints becomes equal to the predetermined value, the image forming apparatus is set in a non-printable state.

According to another aspect of the present invention, there is provided an image forming method comprising: a developing step of controlling a developing unit that visualizes an image; a supply step of controlling a supply unit that supplies an image forming material, which is stored in image forming material storing means, to a downstream side; an opening/closing sensing step of detecting opening/closing of a door that covers the image forming material storing means and is openably provided; a cut-off step of rendering, if the door is open, the supply unit inoperable, and rending, if the door is closed, the supply unit operable; a step of counting, while the opening of the door is detected in the opening/closing sensing step, a number of prints during this time period; a step of rendering, if the counted number of prints is less than a predetermined value, the developing unit operable, and setting the image forming apparatus in a printable state; and a step of setting, if the counted number of prints becomes equal to the predetermined value, the image forming apparatus in a non-printable state.

Additional objects and advantages of an aspect of the invention will be set forth in the description which follows, and in part will be obvious from the description, or may be learned by practice of the invention. The objects and advantages of an aspect of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate presently preferred embodiments of the invention, and together with the general description given above and the detailed description of the embodiments given below, serve to explain the principles of an aspect of the invention.

DETAILED DESCRIPTION OF THE INVENTION

An embodiment of the present invention will now be described with reference to the accompanying drawings.

Figure 1:
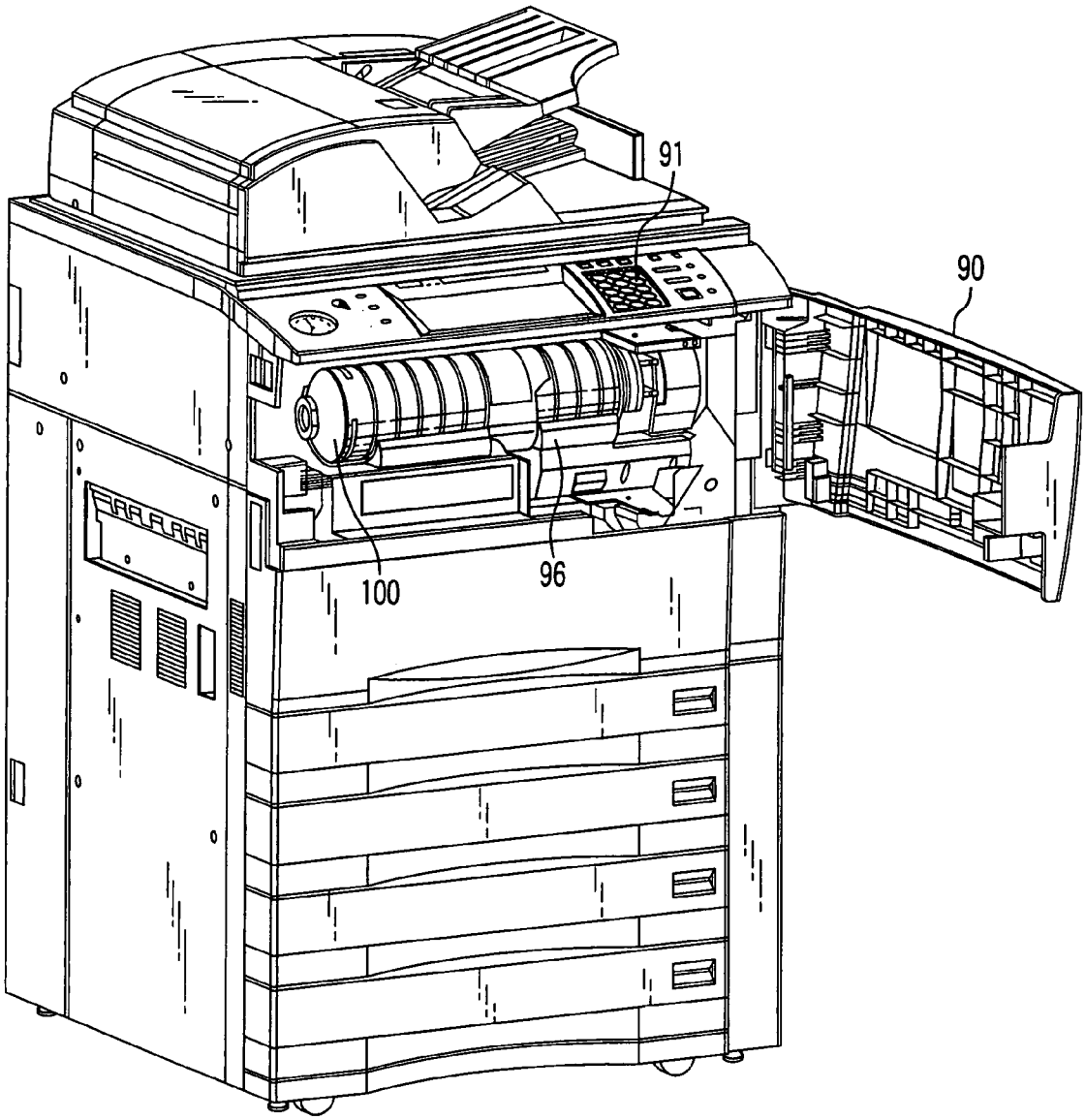
FIG. 1 shows the external appearance of an image forming apparatus according to an embodiment of the present invention.

FIG. 1 shows the external appearance of an image forming apparatus according to an embodiment of the invention. FIG. 1 is a perspective view showing the front side of the image forming apparatus in the state in which a first door 90 that is openably provided for removing a toner bottle 100, which is image forming material storing means, is opened. The toner bottle 100 and an accommodation section for accommodating the toner bottle 100 are disposed on the inside of the first door 90. The toner bottle 100 can be taken out. The toner bottle 100 is a container having a helical portion on the inner peripheral surface thereof. The toner bottle 100 is rotated by an external drive force, and toner in the toner bottle is supplied through an opening portion thereof. A control panel 91 for executing various operational inputs is provided on the upper front part of the image forming apparatus.

Figure 2:
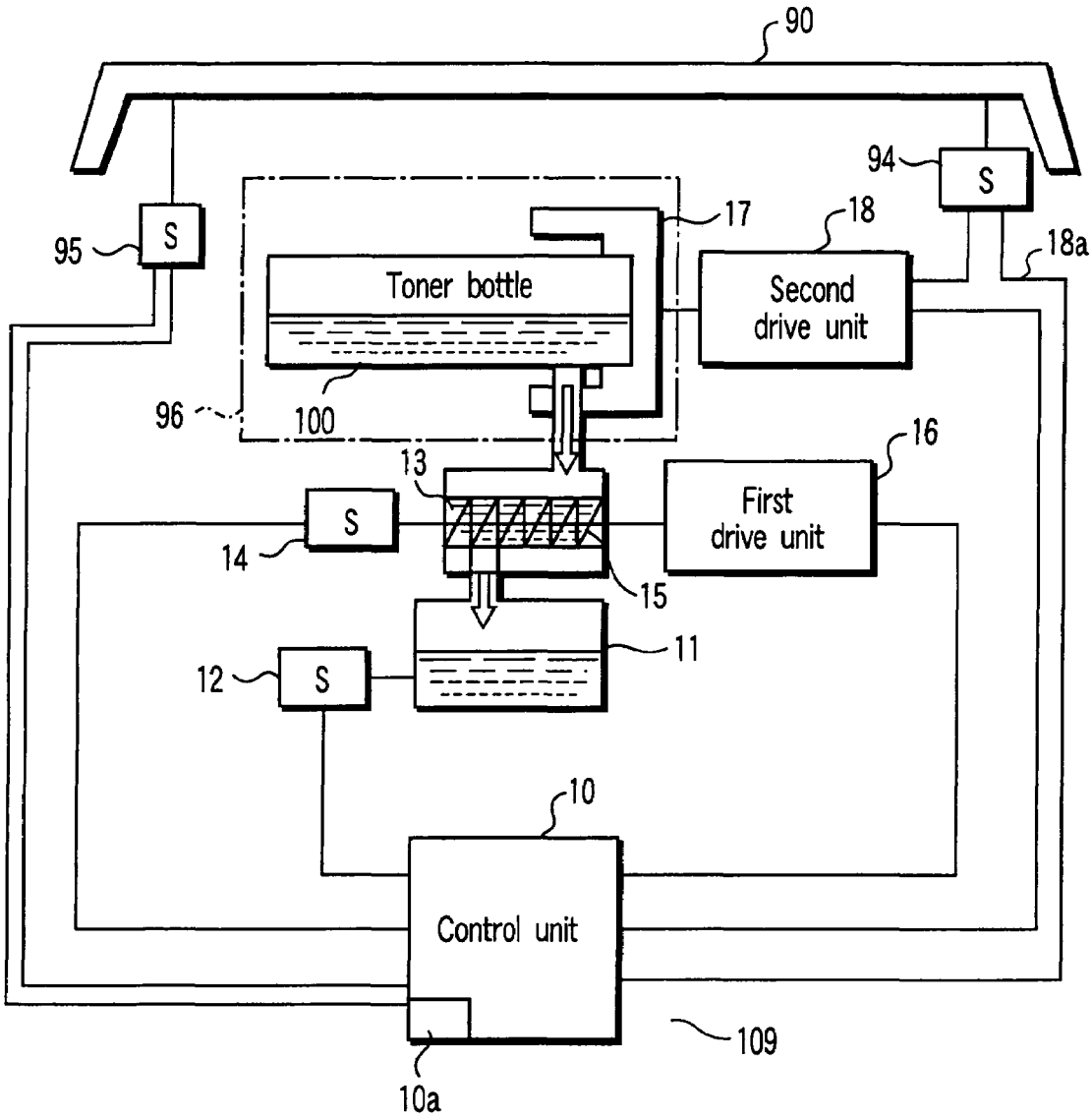
FIG. 2 schematically shows the structure of an image forming section of the image forming apparatus according to the embodiment of the present invention.

FIG. 2 schematically shows the structure of the region of the image forming section of the image forming apparatus.

The region of the image forming section of the image forming apparatus includes a control unit 10, a developing unit 11, a developing unit toner amount sensor 12, a storage unit 13, a storage unit toner amount sensor 14, a first supply unit 15, a first drive unit 16, a second supply unit 17, a second drive unit 18, first door 90, a cut-off switch 94 that is cut-off means, an opening/closing detection switch 95 that is opening/closing sensing means, accommodation section 96, and toner bottle 100.

The control unit 10 includes a counter 10*a* that is composed of, for example, a program for counting the number of prints, as will be described later in detail. The developing unit toner amount sensor 12, storage unit toner amount sensor 14, cut-off switch 94 and opening/closing sensing switch 95 are connected to the control unit 10. The control unit 10 controls at least the first drive unit 16, second drive unit 18 and developing unit 11.

The cut-off switch 94, or the cut-off means, is turned on when the first door 90 is opened and is turned off when the first door 90 is closed. In the turn-on state, the cut-off switch 94 renders a power supply circuit 18*a* of the second drive unit 18 conductive. In the turn-off state, the cut-off switch 94 cuts off the power supply circuit 18*a* and renders it non-conductive.

The developing unit 11 forms an image on a photoconductor drum (not shown) using toner.

The developing unit toner amount sensor 12 detects the amount of toner in the developing unit 11.

The storage unit 13 stores toner that is to be supplied to the developing unit 11.

The storage unit toner amount sensor 14 detects the amount of toner in the storage unit 13.

The first supply unit 15 supplies toner from the storage unit 13 to the developing unit 11. The first drive unit 16 drives the first supply unit 15.

The second supply unit 17 supplies toner, which is contained in the toner bottle 100, to the storage unit 13.

The second drive unit 18 drives the second supply unit 17. When the first door 90 is closed, the cut-off switch 94 is turned on to render the power supply circuit 18*a*, which supplies power to the second drive unit 18, conductive. In this state, if a drive signal is output from the control unit 10, the second drive unit 18 is enabled to drive the second supply unit 17.

On the other hand, when the first door 90 is opened, the cut-off switch 94 is turned off to render the power supply circuit 18*a*, which supplies power to the second drive unit 18, non-conductive. In this state, even if a drive signal is output from the control unit 10, the second drive unit 18 is inoperable and the second supply unit 17 remains in the off-state.

When the storage unit toner amount sensor 14 detects that the amount of toner in the storage section 13 has decreased to a predetermined value or less, the control unit 10 executes a control to activate the second drive unit 18 and to supply toner from the toner bottle 100 to the storage unit 13.

When the developing unit toner amount sensor 12 detects that the amount of toner in the developing unit 11 has decreased to a predetermined value or less, the control unit 10 executes a control to activate the first drive unit 16 and to supply toner from the storage unit 13 to the developing unit 11.

The image forming apparatus includes the first door 90 that is openably provided to take out the toner bottle 100, and the opening/closing sensing switch 95 that detects opening/closing of the first door 90. The image forming apparatus includes a second door (not shown), in addition to the first door 90. Since the second door is not related to the present invention, a description thereof is omitted.

If the first door 90 is opened and the cut-off switch is turned off, the power supply circuit 18*a* of the second drive unit 18 is cut off and the second drive unit 18 is rendered inoperable. Accordingly, the second supply unit 17 is set in the off-state. In other words, the image forming apparatus is set in the state in which no toner can be supplied from the toner bottle 100 to the storage unit 13.

Thus, at this time, the toner bottle 100 is not rotated, and the operator can safely take out the toner bottle 100.

Furthermore, during the time in which the opening/closing sensing switch 95 detects the opening of the first door 90, the counter 10*a* of the control unit 10 counts the number of prints. If the count value reaches a predetermined value, the control unit 10 stops the operations of the first drive unit 16 and developing unit 11, thereby preventing a decrease in image density due to shortage in toner amount. In this case, the predetermined value of the number of prints is set at, e.g. 100. This predetermined value may be varied by an input operation through the control panel 91, which is a setting unit, by choosing a number from a range of 100 to 2000 in units of 100. The setting unit may be configured such that the setting unit is connected to an external controller (not shown) such as a personal computer, and the predetermined value is varied by inputting a desired number through the external controller.

Regardless of whether the toner bottle 100 is replaced or not, if the opening/closing sensing switch 95 detects the closing of the first door 90, the control unit 10 resets the count value of the counter 10*a*, which is indicative of the number of prints. Further, if the developing unit toner amount sensor 12 detects that the amount of toner in the developing unit 11 decreases to a predetermined value or less, the control unit 10 executes a control to operate the first drive unit 16 and to supply toner from the storage unit 13 to the developing unit 11. In addition, if the storage unit toner amount sensor 14 detects that the amount of toner in the storage unit 13 decreases to a predetermined value or less, the control unit 10 executes a control to operate the second drive unit 18 and to supply toner from the toner bottle 100 to the storage unit 13. Hence, the control unit 10 resumes the printing operation.

Figure 3:
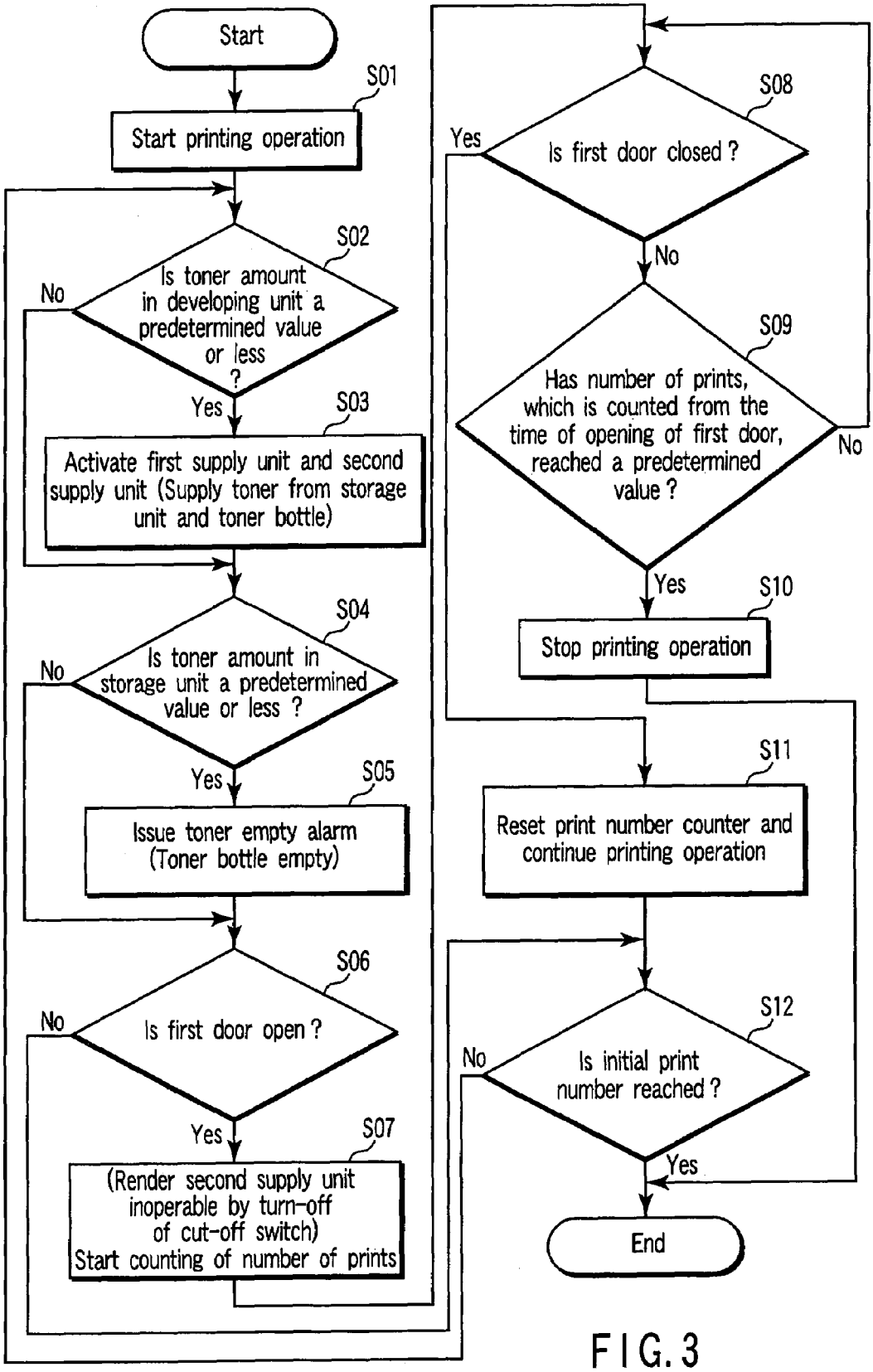
FIG. 3 is a flow chart that illustrates the operation of the image forming apparatus according to the embodiment of the present invention.

Next, the control operation of the image forming apparatus according to the embodiment is described referring to a flow chart of FIG. 3.

When a print start button (not shown) on the control panel 91 is pressed, the control unit 10 starts a printing operation (S01).

When the printing operation is started, the control unit 10 instructs the developing unit toner amount sensor 12 to detect the whether the amount of toner in the developing unit 11 is a predetermined value or less (S02).

If the amount of toner in the developing unit 11 is the predetermined value or less, the control unit 10 activates the first drive unit 16 for supplying toner from the storage unit 13 to the developing unit 11, and the second drive unit 18 for supplying toner from the toner bottle 100 to the storage unit 13 (S03). In step S02, if the amount of toner in the developing unit 11 is greater than the predetermined value, the control unit 10 goes to step S04.

Then, the control unit 10 detects, with use of the storage unit toner amount sensor 14, whether the amount of toner in the storage unit 13 is a predetermined amount or less (S04).

If the amount of toner in the storage unit 13 is the predetermined amount or less, the control unit 10 determines shortage of toner in the toner bottle 100 and causes the display section (not shown) of the control panel 91 to display an alarm message indicating the toner empty state (S05). Alternatively, alarm sound may be produced, or both the alarm message and alarm sound may be used.

Then, the control unit 10 detects, with use of the opening/closing sensing switch 95, whether the first door 90 is opened (S06).

If the first door 90 is opened and the cut-off switch 94 is turned off, the power supply circuit 18*a* of the second drive unit 18 is cut off and the second drive unit 18 is rendered inoperative (i.e. stop of operation of the toner bottle 100). In this case, the counter 10*a* of the control unit 10 starts counting the number of prints of the image forming apparatus from the time of detection of the opening of the first door 90 (S07).

Assuming that the replacement of the toner bottle 100 is completed, the control unit 10 detects, by means of the opening/closing sensing switch 95, whether the first door 90 is closed (S08).

If the first door 90 is still open in step S08, the control unit 10 checks whether the number of prints, which is counted by the counter 10*a* from the time of opening of the first door 90, has reached a predetermined value (S09). If the number of prints does not reach the predetermined value in step S09, the control unit 10 returns to step S08.

If the number of prints reaches the predetermined value in step S09, the control unit 10 stops the printing operation (S10).

If the closing of the first door 90 is detected in step S08, the control unit 10 resets the count value of the number of prints in the counter 10*a*, and continues the printing operation (S11).

Subsequently, the control unit 10 determines whether the initial value of the number of prints, which was set through the control panel 91 at the time of starting the printing operation, is reached (S12).

If the initial value of the number of prints is not reached, the control unit 10 returns to step S02 and continues the printing operation. If the initial value of the number of prints is reached, the printing operation is completed.

In an applied example of the present invention (although not shown, the cut-off switch 94 in FIG. 2 is omitted, and the power supply circuit 18*a* of the second drive unit 18 is always connected), the cut-off switch 94 that is the cut-off means, which is operated by the opening/closing of the first door 90, may be omitted. In the applied example in which the cut-off switch 94 for stopping the second drive unit 18 is omitted, if the opening/closing sensing switch 95 detects the opening of the first door 90, the control unit 10 executes a control to render the first drive unit 16 and developing unit 11 operable and to render the second drive unit 18 inoperable. Thereby, when the first door 90 is opened to take out the toner bottle 100, the second drive unit 18 is controlled to be inoperable and the supply of toner from the second supply unit is stopped. At this time, no toner flows from the toner bottle 100 to the downstream side, and the operator can take out the toner bottle 100 from the image forming apparatus.

According to the above structure, while the opening/closing sensing means detects the opening of the door that covers the image forming material storing means and is openably provided, the control unit counts the number of prints. If the count value of the number of prints is less than a predetermined value, the supply unit that supplies the image forming material from the image forming material storing means to the downstream side is set in the inoperable state, the developing unit is set in the operable state and the image forming apparatus is thus set in the printable state. If the count value of the number of prints reaches the predetermined value, the image forming apparatus is set in the non-printable state.

In the present embodiment, the toner bottle that is the image forming material storing means is of the type wherein the toner bottle has a helical inner peripheral wall for conveying toner and does not include the second supply unit. Alternatively, the toner bottle may be of the type wherein the toner bottle includes a convey member as the second supply unit.

The toner bottle may be a toner cartridge (or a toner hopper) that includes a convey member as the second supply unit, or may be a toner cartridge (or a toner hopper) that does not include a convey member as the second supply unit.

As has been described above, according to the present embodiment of the invention, toner replenishment (replacement of a toner bottle) is enabled during a printing operation, thereby enhancing productivity, and a decrease in image density during the printing operation can be prevented.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. An image forming apparatus comprising:

an image forming material storing unit that stores an image forming material;

an accommodation unit that accommodates the image forming material storing unit such that the image forming material storing unit lies in the accommodation unit;

a supply unit that supplies the image forming material, which is stored in the image forming material storing unit, to a downstream side;

a door unit that covers the image forming material storing unit and is openably provided;

an opening/closing sensing unit that detects opening/closing of the door unit; and a developing unit that is set in a printable state, when a number of prints is smaller than a predetermined value, while the opening/closing sensing unit detects opening of the door, and is set in a non-printable state, when the number of prints becomes equal to the predetermined value, while the opening/closing sensing unit detects opening of the door.

2. An image forming apparatus according to claim 1, comprising:

a cut-off unit that renders the supply unit inoperable, when the opening/closing sensing unit detects opening of the door, and renders the supply unit operable, when the opening/closing sensing unit detects the closing of the door.

3. An image forming apparatus according to claim 1, further comprising:

a cut-off unit that keeps the supply unit inoperable, when the opening/closing sensing unit detects opening of the door while the image forming apparatus is in the printable state, and keeps the supply unit operable, when the opening/closing sensing unit detects closing of the door while the image forming apparatus is in the printable state.

4. An image forming apparatus according to claim 1, wherein when the developing unit is in the printable state, and the opening/closing sensing unit detects opening of the door, when the number of prints is smaller than the predetermined value, the developing unit is kept in the printable state, and when the number of prints becomes equal to the predetermined value, the developing unit is set in the non-printable state.

5. The image forming apparatus according to claim 1, further comprising:

a setting unit that sets the predetermined value with respect to the number of prints; and a memory unit that stores the predetermined value as data.

6. The image forming apparatus according to claim 5, wherein the memory unit stores an initial value as the predetermined value, and the initial value is input from the setting unit, and changeable to an arbitrary value.

7. An image forming apparatus comprising:

image forming material storing unit that stores an image forming material;

an accommodation unit that accommodates the image forming material storing unit such that the image forming material storing unit lies in the accommodation unit;

a door unit that covers the image forming material storing unit and is openably provided;

an opening/closing sensing unit that detects opening/closing of the door unit;

a storage unit that stores the image forming material;

a first supply unit that supplies the image forming material from the storage unit;

a second supply unit that supplies the image forming material to the storage unit, which is stored in the image forming material storing unit, and halts supplying of the image forming material, when the number of prints becomes smaller than a predetermined value, while the opening/closing sensing unit detects opening of the door;

a developing unit that is supplied with the image forming material from the first supply unit, and that is set in a printable state, when the number of prints is smaller than a predetermined value while the opening/closing sensing unit detects opening of the door, and is set in a non-printable state, when the number of prints becomes equal to the predetermined value when the opening/closing sensing unit detects opening of the door.

8. An image forming apparatus according to claim 7, comprising:

a cut-off unit that renders the second supply unit inoperable, when the opening/closing sensing unit detects opening of the door, and renders the second supply unit operable, when the opening/closing sensing unit detects closing of the door.

9. An image forming apparatus according to claim 7, further comprising:

a cut-off unit that renders the second supply unit inoperable, when the opening/closing sensing unit detects opening of the door while the image forming apparatus is in the printable state, and keeps the second supply unit operable, when the opening/closing sensing unit detects closing of the door when the image forming apparatus is in the printable state.

10. An image forming apparatus according to claim 7, wherein when the image forming apparatus is in the printable state, and the opening/closing sensing unit detects opening of the door, when the number of prints is smaller than the predetermined value, the developing unit is set in the printable state, and when the number of prints becomes equal to the predetermined value, the developing unit is set in the non-printable state.

11. An image forming method comprising:

detecting opening/closing of a door unit which covers an image forming material storing unit storing an image forming material, and is openably provided, the image forming material storing unit being accommodated such that the image forming material storing unit lies in an accommodation unit;

supplying the image forming material which is stored in a storage unit to a developing unit;

halting supplying of the image forming material which is stored in the storage unit to the developing unit, when a number of prints is smaller than a predetermined value while opening of the door unit is detected;

setting an image forming apparatus in a printable state, when the number of prints is smaller than the predetermined value when opening of the door unit is detected, and setting the image forming apparatus in a non-printable state, when the number of prints becomes equal to the predetermined value when opening of the door unit is detected.

12. An image forming method according to claim 11, wherein when opening of the door unit is detected, supplying of the image forming material from the image forming material storing unit to the developing unit is halted, and when closing of the door unit is detected, supplying of the image forming material from the image forming material storing unit to the developing unit is maintained.

13. An image forming apparatus according to claim 11, when the image forming apparatus is in the printable state, when opening of the door unit is detected, supplying of the image forming material from the image forming material storing unit to the developing unit is halted, and when closing of the door unit is detected, supplying the image forming material from the image forming material storing unit to the developing unit is maintained.

14. An image forming apparatus according to claim 11, wherein when the image forming apparatus is in the printable state, and opening of the door unit is detected, when the number of prints is smaller than the predetermined value, the image forming apparatus is kept in the printable state, and when the number of prints becomes equal to the predetermined value, the image forming apparatus is set in the non-printable state.

* * * * *